US010344489B2

(12) United States Patent
Koss et al.

(10) Patent No.: US 10,344,489 B2
(45) Date of Patent: Jul. 9, 2019

(54) ADJUSTABLE SUPPORT COLUMN WITH UPLIFT-RESISTING ASSEMBLY

(71) Applicant: WESTERN SULFUR REMELTERS LTD., Calgary (CA)

(72) Inventors: Devon Koss, Calgary (CA); Tony Fisher, Calgary (CA); Mohsen Nejati, Calgary (CA); Michel Boucher, Calgary (CA); Gary Wade, Calgary (CA); Valerie Koss, Calgary (CA)

(73) Assignee: WESTERN SULFUR REMELTERS LTD., Calgary (CA)

( * ) Notice: Subject to any disclaimer, the term of this patent is extended or adjusted under 35 U.S.C. 154(b) by 0 days.

(21) Appl. No.: 15/976,688

(22) Filed: May 10, 2018

(65) Prior Publication Data

US 2018/0328055 A1 Nov. 15, 2018

Related U.S. Application Data

(60) Provisional application No. 62/503,996, filed on May 10, 2017.

(51) Int. Cl.

| | |
|---|---|
| ***E04C 3/00*** | (2006.01) |
| ***E04H 9/02*** | (2006.01) |
| ***E04G 25/02*** | (2006.01) |

(52) U.S. Cl.

CPC ..... *E04G 25/02* (2013.01); *E04H 9/02* (2013.01); *E04C 3/005* (2013.01)

(58) Field of Classification Search

CPC ..... E04G 25/02; E04C 3/005; E04H 12/2284; E04H 9/02

See application file for complete search history.

(56) References Cited

U.S. PATENT DOCUMENTS 3,027,140 A * 3/1962 Holzbach ..... E04G 25/06 248/354.3
3,228,646 A * 1/1966 Lane ..... E04G 25/065 248/354.3

(Continued)

FOREIGN PATENT DOCUMENTS

CA 136200 10/1911
CA 642534 A * 6/1962

(Continued)

OTHER PUBLICATIONS

Excerpt from National Building Code of Canada 2015, vol. 2 Division B, containing section 9.23.13 titled Bracing to Resist Lateral Loads due to Wind and Earthquake.

*Primary Examiner* — Rodney Mintz
(74) *Attorney, Agent, or Firm* — Parlee McLaws LLP (CGY); Linda Thompson; Sean Goodwin

(57) ABSTRACT

An uplift-resisting assembly, connected to a top of a tubular member of a height adjustable structural column, acts to transfer load, particularly uplift loads imposed on the structure to which the column supports, therethrough and into the tubular member. The housing of the assembly is connected to the tubular member, which is connected to a base such as a footing. A threaded rod extends through the housing and into the tubular member. A top plate, connectable to a structure above is attached to the top of the threaded rod. An adjustment nut, threaded onto the threaded rod for adjusting the height of the column is sandwiched between the top of the housing and the top of the tubular member. The adjustment nut bears on the tubular member in compression and bears on the top of the housing during uplift, the uplift being transferred via the housing into the tubular member.

14 Claims, 9 Drawing Sheets

(56) References Cited

U.S. PATENT DOCUMENTS 3,564,786 A * 2/1971 Baker ..... E04B 1/0007 52/126.7
3,704,560 A * 12/1972 Ratliff, Jr. ..... E04G 25/04 52/126.7
3,822,519 A * 7/1974 Antoniou ..... E04B 1/3483 52/79.13
4,122,645 A * 10/1978 Tooley ..... E04G 11/486 52/651.1
4,281,487 A * 8/1981 Koller ..... F16F 7/125 248/351
5,056,750 A * 10/1991 Ellithorpe ..... E04B 1/2612 248/354.3
5,186,430 A * 2/1993 Ellithorpe ..... E04G 25/04 248/354.3
5,819,482 A * 10/1998 Belke ..... E04C 3/005 52/126.6
6,349,512 B1 * 2/2002 Berkey ..... E04G 25/06 52/126.6
7,922,145 B2 * 4/2011 Martin ..... B28B 7/0032 248/176.3
8,381,462 B1 * 2/2013 Sims ..... F16B 7/025 248/200.1
8,407,967 B2 * 4/2013 Brindle, Jr. ..... E04O 3/005 52/126.7
8,453,416 B2 * 6/2013 Brindle ..... E04O 3/32 52/126.7
8,474,206 B2 * 7/2013 Favell ..... E04H 12/2284 256/65.14
8,826,629 B1 * 9/2014 Brindle ..... E04O 3/005 52/126.7
9,732,521 B2 * 8/2017 Babikian ..... E04B 2/74
9,822,530 B2 * 11/2017 Reisdorff ..... E04C 3/30
2006/0283434 A1 * 12/2006 Johnson ..... E04C 3/005 124/74
2009/0194665 A1 * 8/2009 Martin ..... B28B 7/0014 249/18
2009/0293422 A1 * 12/2009 Brindle, Jr. ..... E04O 3/005 52/854
2010/0300038 A1 * 12/2010 Brindle ..... E04O 3/005 52/849
2010/0300039 A1 * 12/2010 Favell ..... E04H 12/2284 52/849
2012/0324821 A1 * 12/2012 Kordecki ..... E04G 21/243 52/708
2014/0260082 A1 * 9/2014 Brindle ..... E04O 3/005 52/831
2015/0267424 A1 * 9/2015 Reisdorff ..... E04C 3/30 52/514

FOREIGN PATENT DOCUMENTS

CA 675000 11/1963
CA 704587 3/1965
CA 949056 6/1974
CA 968118 5/1975
CA 970353 7/1975

* cited by examiner

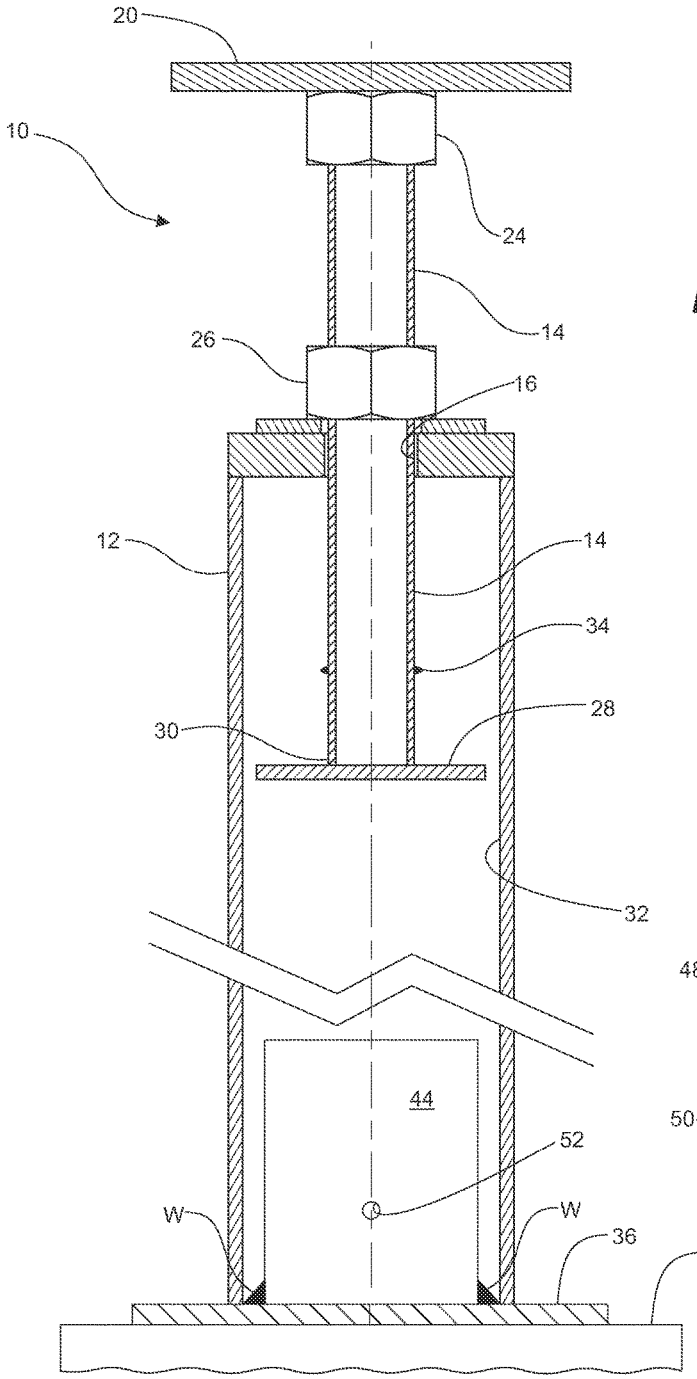
Fig. 1Bi
PRIOR ART
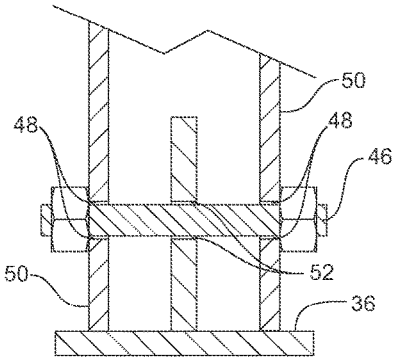
Fig. 1Bii
PRIOR ART

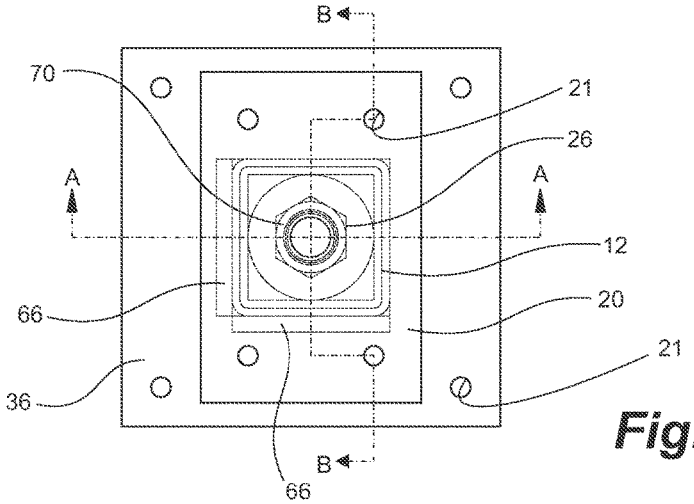
Fig. 2Aiii
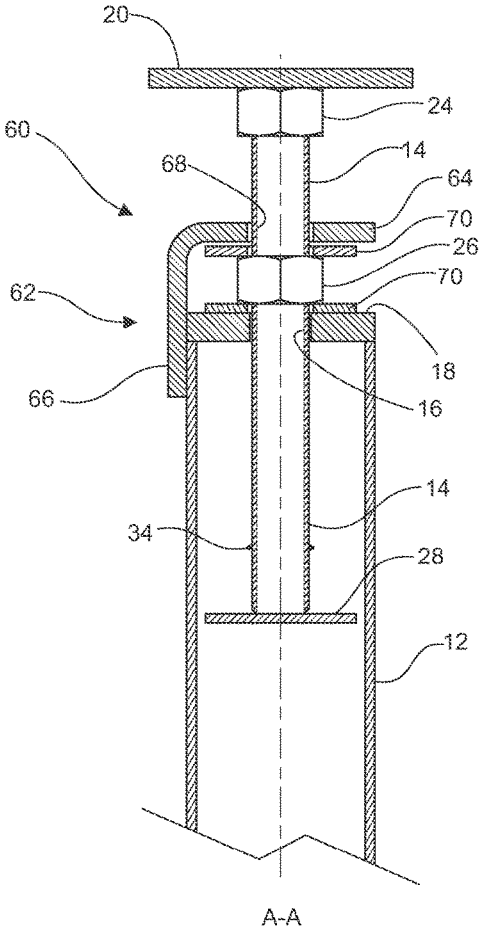
Fig. 2Ai
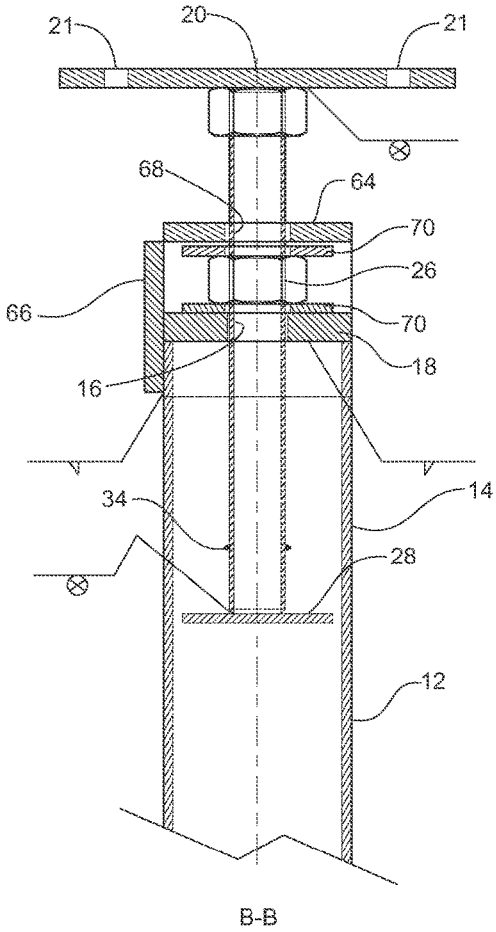
Fig. 2Aii

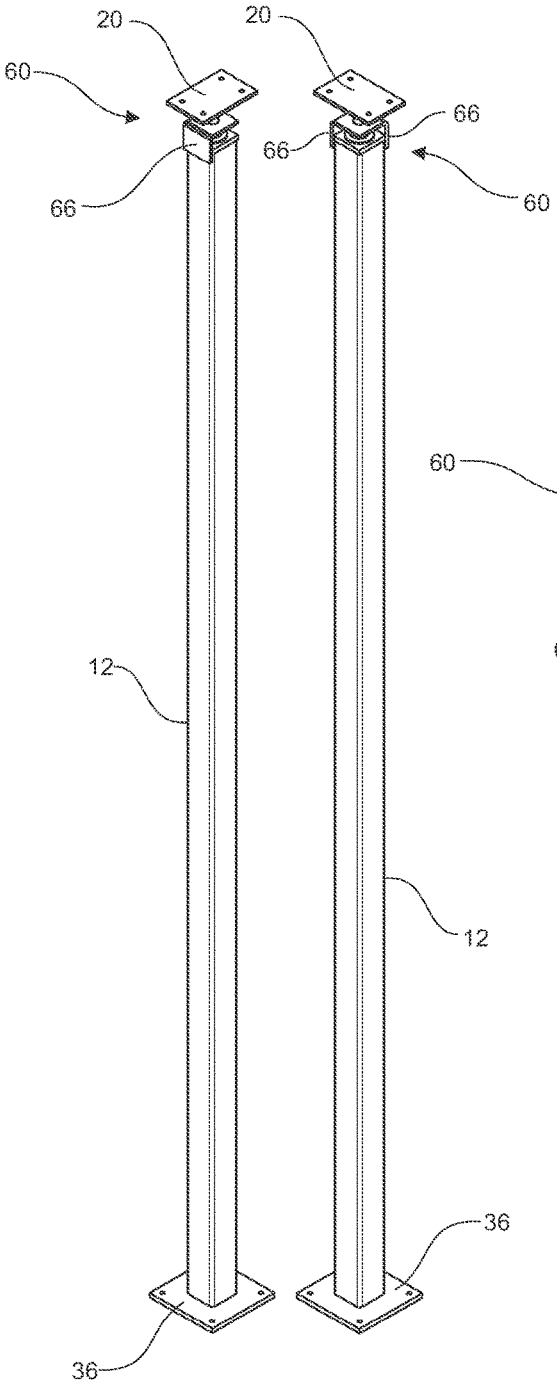
Fig. 2Bi Fig. 2Bii
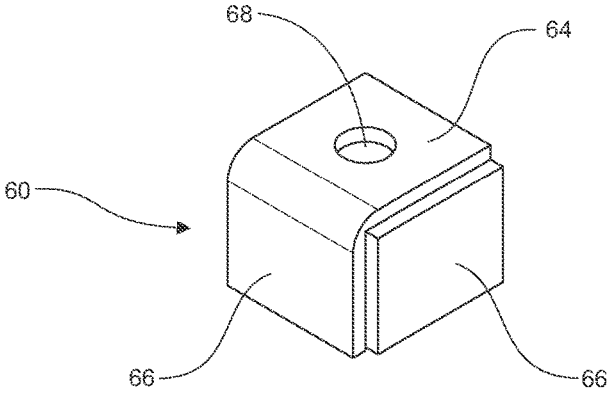
Fig. 2Biii
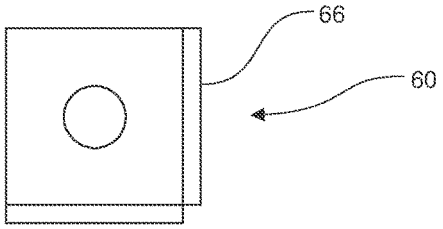
Fig. 2Biv

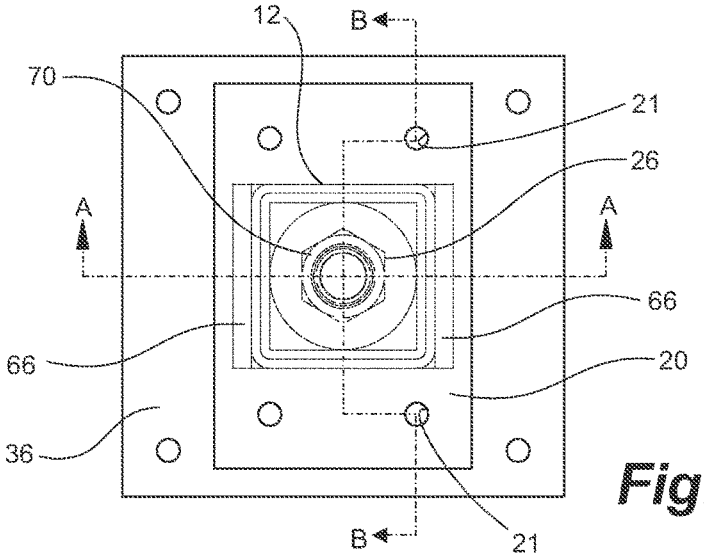
Fig. 3Aiii
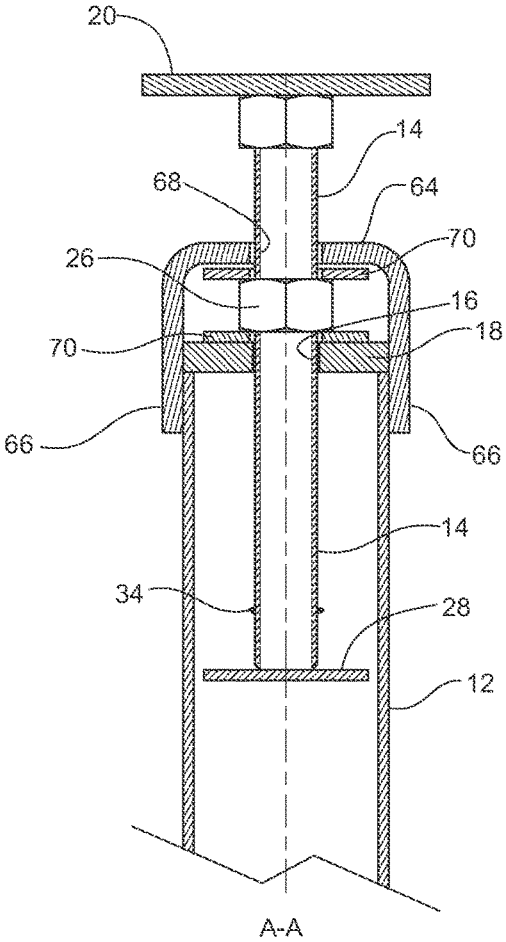
Fig. 3Ai
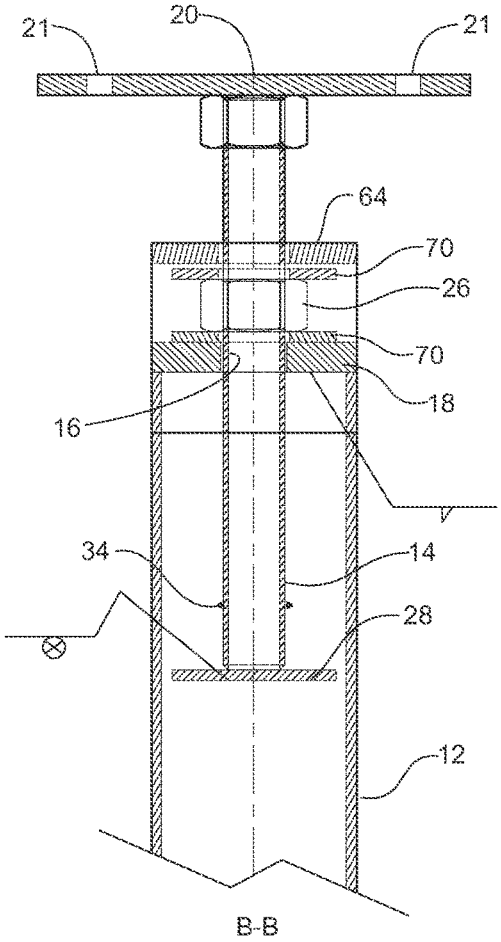
Fig. 3Aii

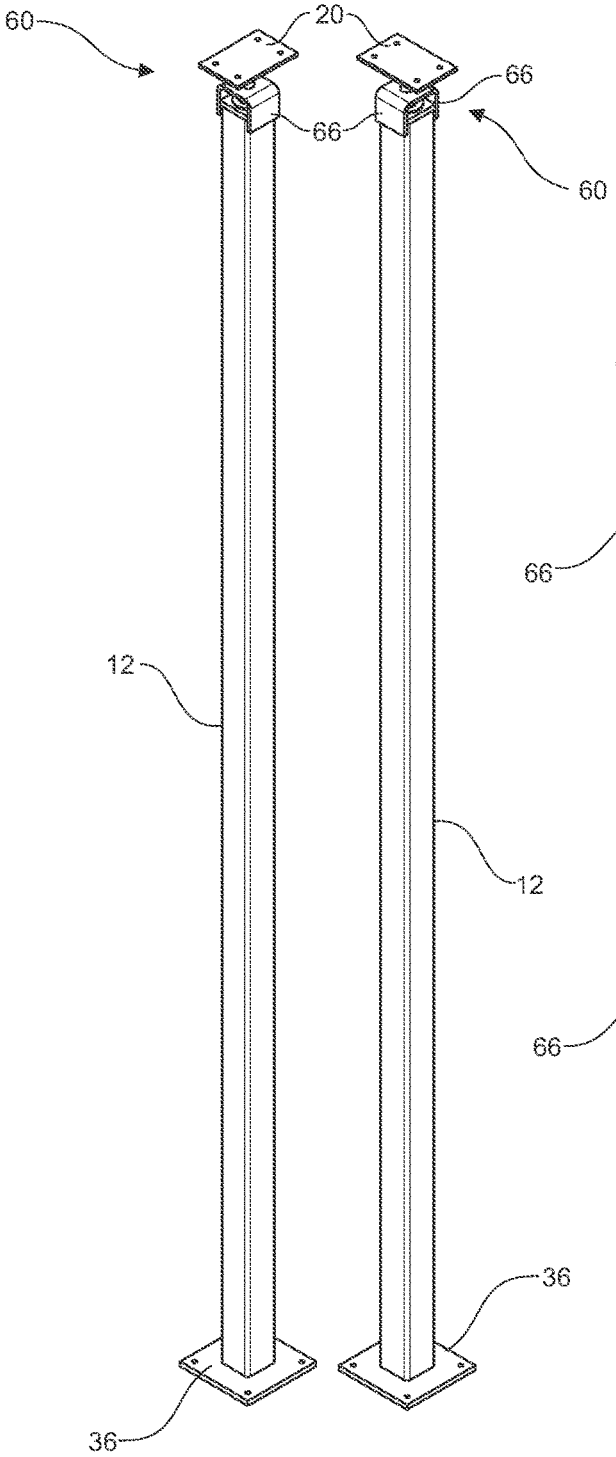
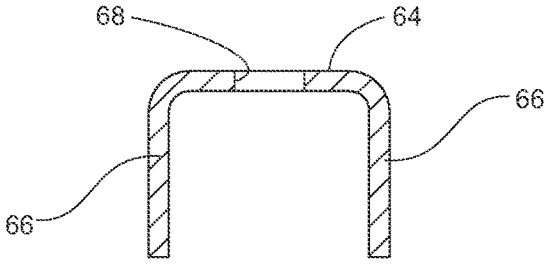
Fig. 3Biii
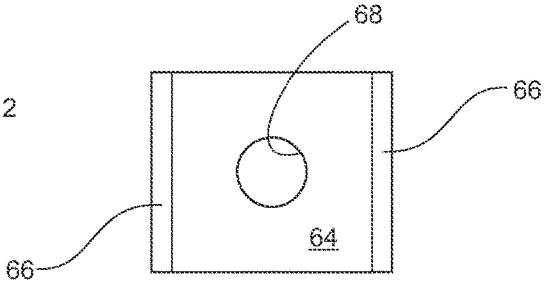
Fig. 3Biv
Fig. 3Bi Fig. 3Bii

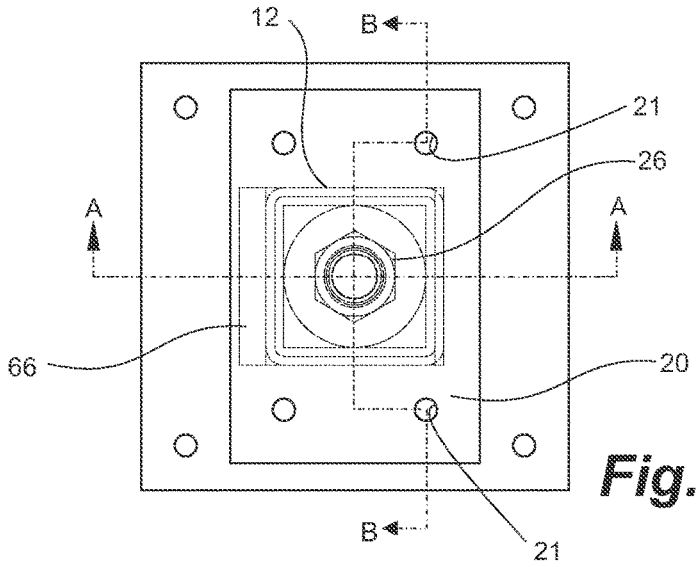
Fig. 4Aiii
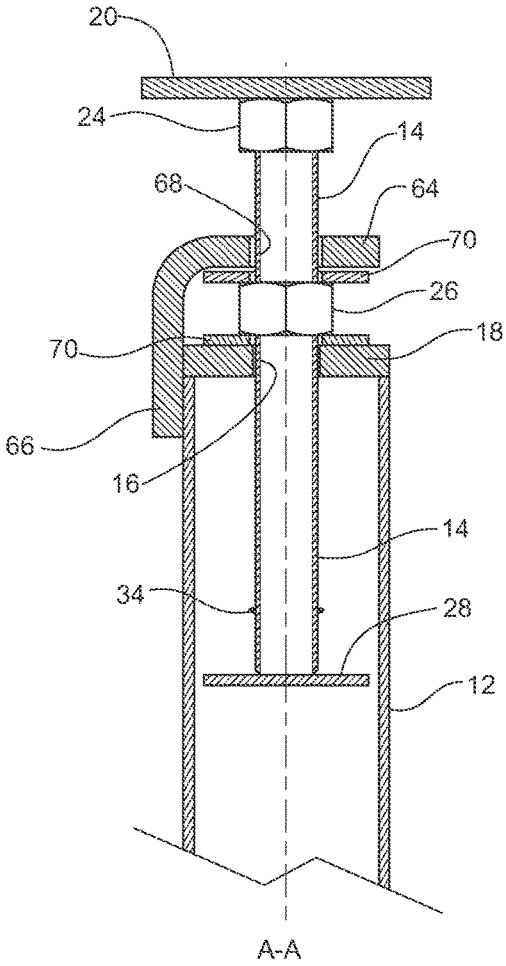
Fig. 4Ai
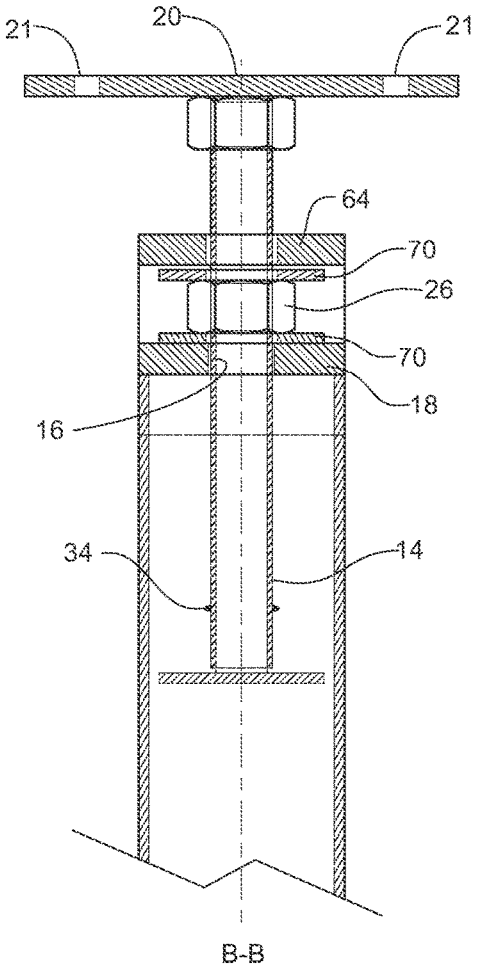
Fig. 4Aii

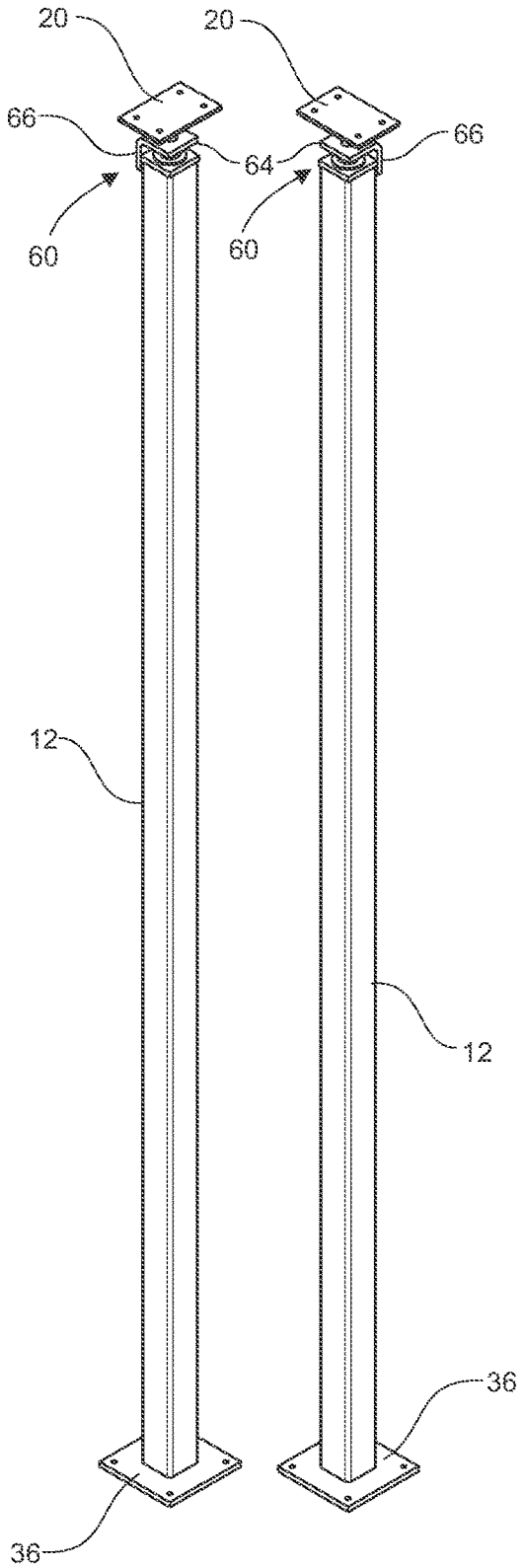
Fig. 4Bi Fig. 4Bii
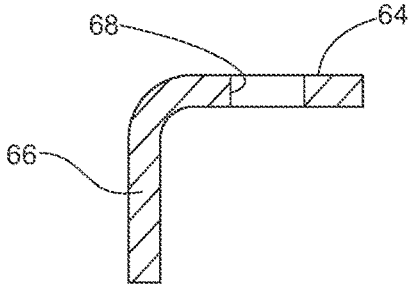
Fig. 4Biii
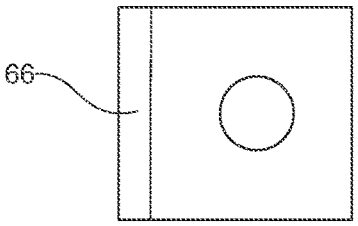
Fig. 4Biv

ADJUSTABLE SUPPORT COLUMN WITH UPLIFT-RESISTING ASSEMBLY

CROSS-REFERENCE TO RELATED APPLICATIONS

This application claims the benefits under 35 U.S.C 119(e) of U.S. Provisional Application Ser. No. 62/503,996, filed May 10, 2017, the subject matter of which is incorporated fully herein by reference.

FIELD

Embodiments herein relate to apparatus and methods for supporting beams, ceilings and floors of a building and, more particularly, to columns having apparatus for minimizing the effect of tension loading or uplift, such as resulting from wind loading and/or seismic activity and the like.

BACKGROUND

It is known in the art to use support columns, particularly those that permit limited height adjustability of the column, for supporting elements of a structure, such as upper floors. As described in U.S. Pat. No. 5,056,750 to Ellithorpe, early columns used a structural column having a single, threaded support rod extending therefrom (Canadian patent 136,200 to Beichert and Canadian patent 704,587 to Russo). Further, support assemblies are known having central threaded members to which flanking members are attached for forming a saddle for engaging elements such as structural beams (Canadian patent 949,056 to Ratliff). Similarly, supports are known which provide upwardly and inwardly inclined jack units having levers and braces, such as chains, between angled bases and opposite converging tops of screw jacks, such that when the braces are tightened, the heads function as jaws (Canadian patent 642,534 to Teel). Additionally, columnar structures are known in which adjustment of column height requires adjustment not only of the thickness of baseplates, but also of nuts and bolts throughout the column (Canadian patents 675,000 to Dielman and 968,118 to Antoniou).

As well, a complex combination of a jack screw, levelling nut, tension plate and U-shaped bolt, arranged transversely rather than longitudinally with respect to a beam and passing through the tension plate to be fastened on the lower side thereof by hold down nuts, is known from Canadian patent 970,353 to McMichael.

Some of the above-mentioned patents describe devices suitable for permanent support, whilst others are more suitable for temporary support. In addition, the above-mentioned prior art patents present devices that are somewhat complex, both in their structure and in their manner of use and have poor moment carrying capacity.

In Applicant's U.S. Pat. No. 5,056,750, now expired, a moment-resisting member is placed centrally between height adjustment means. Moment-carrying capacity is provided by a saddle comprising a load engaging member having threaded rods flanking a telescopic assembly, substantially reducing a prior "hinge connection" at the top of columns. As well, the telescopic assembly absorbs bending loads whereas the flanking threaded rods carry compressive loads only. The resulting saddle is also adjustable in height even when loaded.

As will be understood by those of skill in the art, wind causing upward lifting of a structure and excessive lateral loading, can cause structural damage and potential collapse, as can seismic activity. Excessive lateral loading can cause a structural frame to deflect from a normal square or rectangular shape to form a parallelogram. The shift to the parallelogram compromises the structural integrity of the frame and may ultimately lead to partial or complete collapse of the structure.

Further uplift, generally as a result of wind lifting, may cause damage to the roof, weakening the structural integrity. As wind flows over the building, the pressure directly above the surface of the roof decreases. At the same time, internal air pressure increases due to air infiltration through openings, cracks, etc. The result is a net upward force on the roofing system.

It is currently known to minimize uplift and the effects of lateral and shear loading, such as during an earthquake or high-wind situation, including but not limited to a tornado. Applicant currently provides a series of pre-engineered steel columns, marketed as WM series columns, which can be used with or without known means for preventing uplift. In the case where uplift is addressed, beams supported by the structural columns are fastened thereto, such as by bolting to a top plate supported on the column or to a saddle attached to the top plate. Further, a base of the column is secured to a base structure, such as a footing, such as by bolting the base plate thereto. The column is then secured to the base plate, such as by welding or by passing a bolt through both the square column and an upstanding member welded to the base plate. In some cases, concrete is poured over the footing and around the base of the column for additional support.

Generally, pre-engineered steel support columns are designed to support vertical or compression loading only. Recent changes to building codes, such as to part 9 of the National Building Code (NBC) require measures to prevent uplift of the structure, over and above those currently incorporated in existing support columns and as described above for the WM series columns. Specifically the changes to the NBC are included in new section 9.23.13, titled "Bracing to Resist Lateral Loads due to Wind and Earthquake.

Thus, there is a requirement and therefore great interest in the industry to ensure that columns, particularly when used as part of a braced wall panel or shear wall, are capable of meeting building code requirements for lateral loading and lifting, such as from wind and seismic activity.

SUMMARY

Embodiments of an uplift-resisting assembly taught herein provide uplift resistance, when connected to an upper end of a support column, capable of meeting or exceeding current building codes with respect to uplift, such as due to seismic activity or wind loading.

In one broad aspect, a structural column resistant to compression and uplift load by a structure thereabove comprises an elongate, tubular member having a bore formed therethrough, an open bottom end and a closed top end, the closed top end having an opening therethrough. A housing, having a top with an opening formed therein and at least one side wall extending therefrom is connected to the tubular member for spacing the top of the housing above the top of the tubular and at least one open side. A threaded rod, extends through the opening in the top of the housing and the opening in the closed top end of the tubular member and into the bore thereof and is retained therein. An adjustment nut is threaded to the threaded rod and is rotatably positioned between the top of the housing and the closed top end of the tubular member for adjusting an effective height of the column. A top plate is connected to a top of the threaded rod adapted for attachment to the structure thereabove for transferring load from the structure to the threaded rod. A bottom plate is connected to a lower end of the tubular member, the bottom plate adapted for connecting to a base structure. The adjustment nut bears against the top of the housing in uplift and against the closed top of the tubular member in compression.

In another broad aspect, an uplift-resisting assembly, for use with a hollow structural column having a closed top end having an opening therethrough for a threaded rod a top plate connected to a top of the threaded rod for attachment to a structure thereabove and a bottom plate for connection to a lower end of the tubular member, the bottom plate for connecting to a base structure, comprises a housing, having a top with an opening formed therein for the threaded rod, at least one side wall extending therefrom for connection to the tubular member for spacing the top of the housing from the closed top, and at least one open side. An adjustment nut is threaded on the threaded rod and is rotatably positioned between the top of the housing and the closed top for adjusting an effective height of the column, wherein the adjustment nut bears against the top of the housing in uplift and against the closed top of the tubular member in compression.

In embodiments, the housing has a single side wall, two side walls that are adjoining or two walls that are opposing. The open sides, absent side walls, form access openings to access the adjustment nut, such as with a wrench. The at least one wall of the housing overlaps and is connected to the tubular member, such as by welding, for transferring load from the threaded rod into the column, particularly under uplift conditions. In embodiments, washers or the like, sandwich the adjustment nut therebetween and further aid in transferring load from the threaded rod into the tubular member. The spacing between the housing and the top of the tubular member is such that the adjustment nut can be rotated for adjusting column height while minimizing any lifting of the threaded rod.

BRIEF DESCRIPTION OF THE DRAWINGS

FIGS. 1Bi and 1Bii are cross-sectional views of the column of FIG. 1A wherein the column is attached to the base plate for securing to a base structure for minimizing uplift according to a prior art method, which does not reliably meet current code;

FIGS. 2Ai, 2Aii, 2Aiii, 2Bi, 2Bii, 2Biii and 2Biv are various views illustrating an embodiment of an uplift-resisting assembly having a top and two adjoining side walls, installed at a top end of the column of FIG. 1B, a top plate of the column and a top of a housing of the uplift-resisting assembly being transparent for viewing the underlying components;

FIGS. 3Ai, 3Aii, 3Aiii, 3Bi, 3Bii, 3Biii and 3Biv are various views illustrating another embodiment of the uplift-resisting assembly according to FIG. 2 having a top and two opposing side walls, installed at a top end of the column of FIG. 1B, a top plate of the column and a top of a housing of the uplift-resisting assembly being transparent for viewing the underlying components; and FIGS. 4Ai, 4Aii, 4Aiii, 4Bi, 4Bii, 4Biii and 4Biv are various views illustrating another embodiment of the uplift-resisting assembly according to FIG. 2, having a top and one side wall, installed at a top end of the column of FIG. 1B, a top plate of the column and a top of a housing of the uplift-resisting assembly being transparent for viewing the underlying components.

DETAILED DESCRIPTION

Prior Art

Figure 1A:
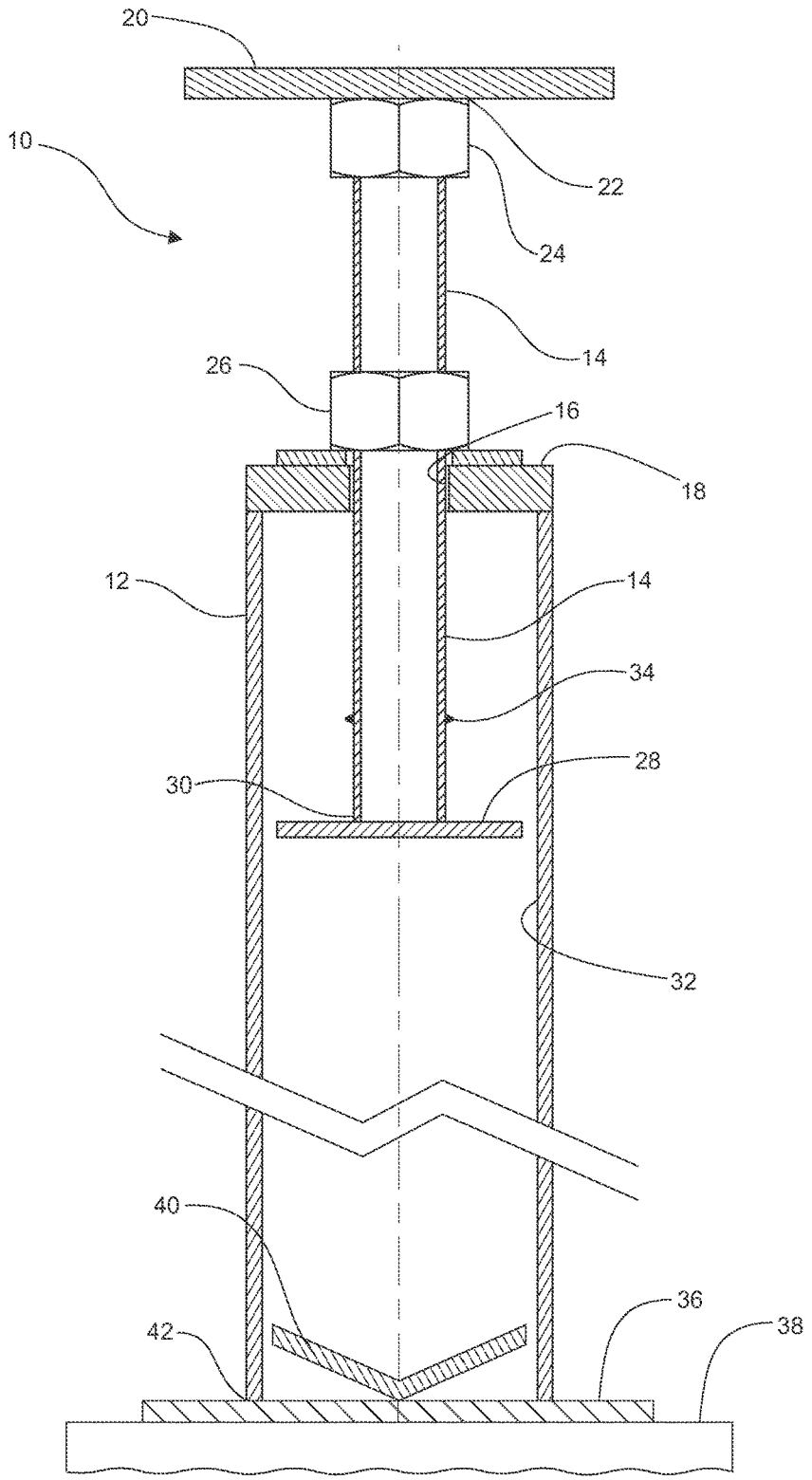
Fig. 1A PRIOR ART
FIG. 1A is a cross-sectional view of a prior art height-adjustable support column, sold by Applicant as "WM series" pre-engineered columns, having a loose base plate, for securing to a base structure, and without means to address uplift.

Having reference to FIG. 1A, in Applicant's WM series of pre-engineered steel support columns 10, designed to withstand compression loading, an elongate, tubular member 12, generally square, has a single threaded rod 14 installed in an opening 16 formed in a closed top end 18 thereof. The threaded rod 14 is moveable axially therein a limited distance to permit height adjustment of the column 10. A top plate 20 is secured to a top 22 of the threaded rod 14, such as by welding. The top plate 20 may be welded to a nut 24, positioned and fixed at the top 22 of the rod 14, as shown, or may be welded using gussets or other means which provide a greater surface area of connection between the rod 14 and the top plate 20. The top plate 20 has holes therethrough to permit fastening to a structure, such as a beam, carried thereon. Axial movement of the threaded rod 14 is delimited, such as by an adjustment nut 26. The adjustment nut 26 is turned along the threaded rod 14 to raise or lower the top plate 20 to adjust an effective height of the column 10.

A laterally-extending member 28, such as a plate, is connected to a lower end 30 of the threaded rod 14, which extends within a bore 32 of the tubular member 12, to minimize lateral movement of the threaded rod 14 therein and the structure connected thereto. In embodiments, a radially extending bead 34 is formed on the threaded rod 14 to prevent the rod 14 from leaving the opening 16 in the top end 18 of the tubular member 12. A separate base plate 36 is supported, such as centered on a base structure 38, such as a concrete footing, and is fastened thereto, such as using bolts or other suitable fasteners. Angled tabs 40 extend upwardly from the base plate 36 about which a lower end 42 of the tubular member 12 is placed, the angled tabs 40 extending upwardly in the bore 32 to prevent the column 10 from sliding about the base plate 36 under compression loading. No means are provided to minimize or prevent uplift, such as during a seismic event or as a result of wind loading.

As shown in FIGS. 1Bi and 1Bii, to provide some prior art resistance to uplift, the tubular member 12 is further attached to the base plate 36, such as by positioning the bore 32 over an upstanding member 44, connected such as by welding W to the base plate 36. A suitable fastener 46, such as a bolt, is passed transversely through holes 48 formed in opposing sides 50 of the tubular member 12 and a hole 52 formed in the upstanding member 44. While this prior art method offers some resistance to uplift, the resistance is insufficient to meet current code as set forth in section 9.23.13 of the NBC.

Figure 1C:
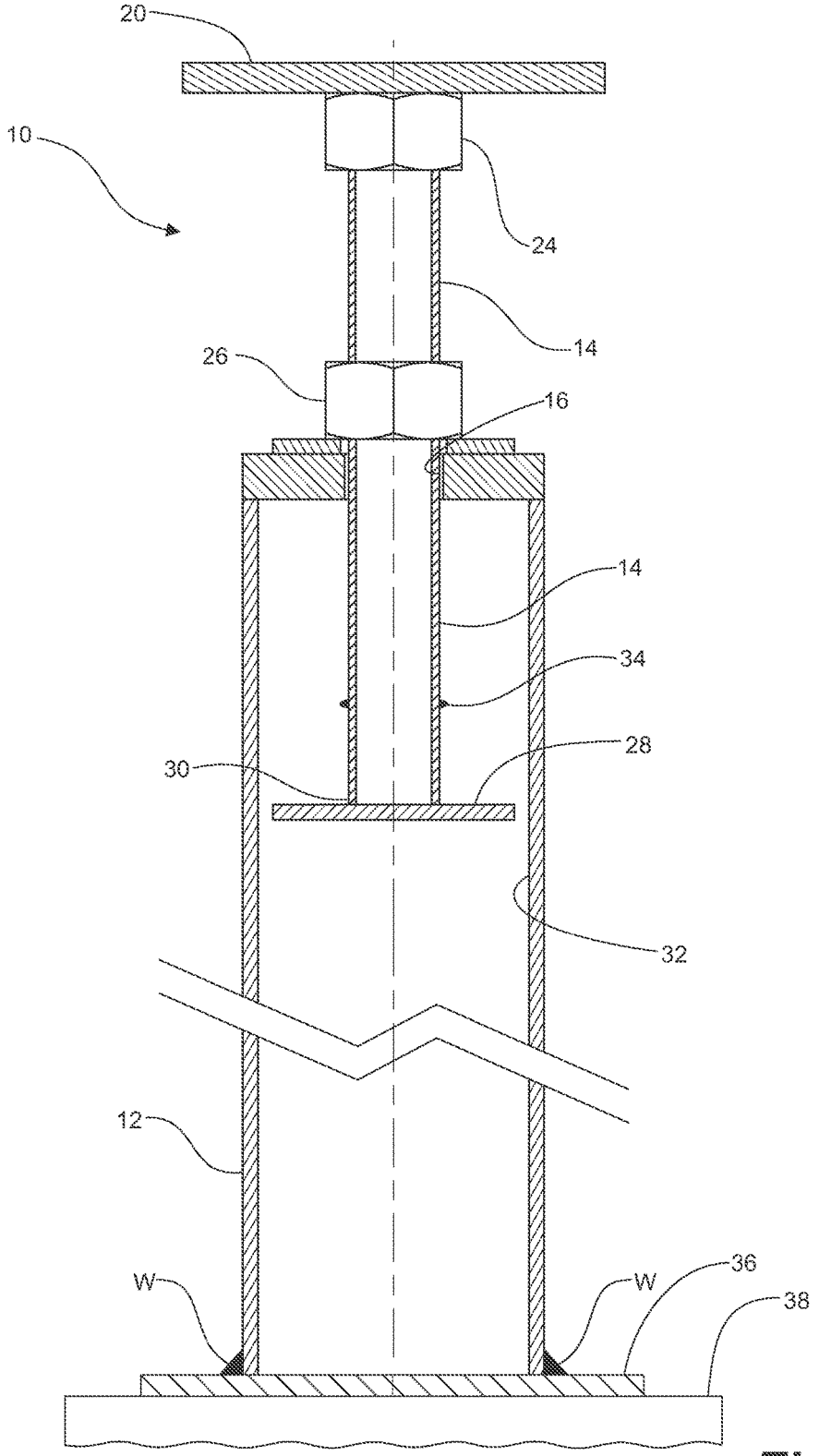
Fig. 1C PRIOR ART
FIG. 1C is a cross-sectional view of the column of FIG. 1A, the column attached directly to the base plate, using an alternate prior art method, typically welding, which may also not reliably meet current code.

Alternatively, as shown in FIG. 1C, the lower end 42 of the tubular member 12 can be secured directly to the base plate 36, such as by welding W. As with the embodiment shown in FIG. 1B, such a method of limiting uplift is also insufficient to meet current code as set forth in section 9.23.13 of the NBC.

Further still, in all of the prior art methods described above, the base plate 36 can be adhesively bonded to the base structure 38, which is also insufficient to meet current code as set forth in section 9.23.13 of the NBC.

Embodiments-uplift-resisting assembly

Having reference to FIGS. 2Ai to 4Biv, embodiments taught herein utilize a unique uplift-resisting assembly 60 which, when connected to a structural support column 10, particularly one having a fixed top plate 20 for fastening the structure, such as a beam, thereon, adds resistance to uplift, such as from lateral and tension loading.

An uplift-resisting assembly 60 connected between the threaded rod 14 and the tubular member 12 meets or exceeds current building codes with respect to uplift. While the uplift-resisting assembly 60 as taught herein is generally applicable to support columns in general, having the fixed top plate 20, threaded rod 14 and base plate 36, embodiments are described herein in the context of a particular known, prior art support column, sold by Applicant as the "WM Series" and shown in FIGS. 1A to 1C. The WM column is generally attached to the base plate 36 using the embodiment taught in FIG. 1B and the top plate 20 supported on the threaded rod 14 is fastened to the structure thereabove, such as by fasteners which pass through holes 21 in the top plate 20 and into the structure. Embodiments are applicable to various types of structural components, including but not limited to, engineered wood beams or steel beams.

Embodiments of the uplift-resisting assembly 60 comprise a housing 62 operatively connected between the elongate, tubular member 12 and the threaded rod 14. The housing 62 acts to transfer tension or uplift load, applied to the threaded rod 14 under uplift conditions, from the rod 14 to the tubular member 12, to resist lifting and potential separation of the 14 rod and the supported structure from the tubular member 12. The housing 62 comprises a top 64, spaced above the top 18 of the tubular member 12 and at least one side wall 66, depending from the top 64, and secured to the tubular member 12. The top 64 of the housing 62 has an opening 68 therein through which the threaded rod 14 passes. The adjustment nut 26, rotatable on the threaded rod 14, is located between the top 18 of the tubular member 12 and the top 64 of the housing 62. The adjustment nut 26 bears on the top of the tubular member 12 under compression loading, during normal operation, for transferring load to the tubular member 12 and bears on the top 64 of the housing for transferring uplift load thereto and into the tubular member 12 to which it is connected during uplift conditions.

In embodiments, washers 70 are fit about the threaded rod 14, above and below the adjustment nut 26, to aid in transferring compression loads to tubular member 12 during normal operation and transferring uplift loads to the housing 62 for transfer to the tubular member 12 during uplift conditions.

The housing 62 provides access to the adjustment nut 26 by providing at least one open side, absent a side wall 66. In embodiments, the housing 62 has two open sides, absent side walls 66, at either adjoining sides or opposing sides, to provide access for tools, such as a wrench, used to rotatably engage the adjustment nut 26 during height adjustment of the threaded rod 14 and hence the column 10.

Having reference to FIGS. 2Ai to 2Biv, in a first embodiment, the housing 62 is a two-sided housing having two adjoining depending side walls 66, such as forming a corner, and the top 64 having the opening 68 through which the threaded rod 14 passes. The two side walls 66 are connected, such as by welding, to adjoining sides 72 of the tubular member 12, adjacent the top 18 thereof. A lower end 74 of each of the adjoining side walls 66 that form the housing 62 overlaps the adjoining sides 72 of the tubular member 12 for forming a secure connection thereto. One or more welds are used to secure the side walls 66 to the tubular member 12.

In the embodiment shown in FIGS. 3Ai to 3Biv, the housing 62 is a generally "U-shaped" housing 62 having two opposing side walls 66. The lower ends 74 of the opposing side walls 66 overlap opposing sides 72 of the tubular member 12 and are secured thereto, such as by one or more welds. The housing's top 64 is contiguous with both opposing side walls 66, whether formed as a single piece or connected thereto such as by welding.

In an embodiment as shown, the housing's top 64 is contiguous with one of the side walls 66. Further, in embodiments, the side wall 66 is curved to extend substantially perpendicular thereto for forming the top 64. The top 64 is secured along an adjoining edge 76 to an upper edge 78 of the adjoining side wall 66 for enclosing the housing 62 on two sides, such as by welding. As described above, the washers 70 are located on the threaded rod 14 above and below the adjustment nut 26.

As shown, the top 64 of the housing 62 is spaced above the top 18 of the tubular member 12 to accommodate the adjustment nut 26 and the washers 70 therebetween. Spacing between the top 18 of the tubular member 12 and an underside 80 of the top 64 of the housing 62 of the uplift-resisting assembly 60 is such that there is a bare friction fit. The bare friction fit is such that the adjustment nut 26 on the threaded rod 14 is still operable to be rotated thereon for adjusting the height thereof, but having a height tolerance sufficiently small to minimize or prevent any upward movement of the threaded rod 14 as a result of uplift. More particularly, in embodiments, the spacing between the top 18 of tubular member 12 and the underside 80 of the top 64 of the housing 62 is generally no more than the sum of the thickness of the washers 70 and the thickness of the adjustment nut 26, plus the height tolerance. In the case of a ¾ inch hex adjustment nut 26, an additional from about 1/16 inch to about ⅛ inch in height is added to the spacing to permit free movement of the adjustment nut 26 along the threaded rod 14. For adjustment nuts 26 of different sizes, the height tolerance may vary.

In the embodiment shown in FIG. 3, the housing 62 is a generally "U-shaped" housing 62 having two opposing side walls 66. The lower ends 74 of the opposing side walls 66 overlap opposing sides 72 of the tubular member 12 and are secured thereto, such as by one or more welds. The housing's top 64 is contiguous with both opposing side walls 66, whether formed as a single piece or connected thereto such as by welding.

As shown in FIGS. 4Ai to 4Biv, in yet another embodiment, the housing 62 is generally "L-shaped" and comprises one side wall 66 and the top 64. The lower end 74 of the side wall overlaps and is secured to the side 72 of the tubular member 12. The top 64 is contiguous with the side wall 66, whether formed as a single piece therewith or secured thereto such as by welding.

To increase the strength of the uplift-resisting assembly 60 for embodiments having the housing 62 with the only one side wall 66, the material thickness of the housing 62 is increased. For example, in the case of embodiments having a two-sided housing 62, the material is about 3/16 inch thick whereas in the case of the housing 62 having only one side wall 66 the material is about ⅜ inch thick.

Testing

Three prior art support columns 10, such as shown in FIG. 1B, were tested for comparison with six support columns according to embodiments taught herein. The results are shown in Table A below.

The prior art columns 10 were made having a height of 4 feet, and were connected to the base plate 36 using a ¼" diameter Grade 5 bolt passing through the holes 48 in the tubular member 12 and the hole 52 in the upstanding member 44 welded to the base plate 36. The top plate 20 was connected to the testing machine using four ¼" Grade 8 bolts. The base plate 36 was connected to the testing machine using four ⅝" Grade 8 bolts.

The threaded rod 14 was extended 4 inches above the top 18 of the tubular member 12. An increasing tension or uplift force was applied to each column 10, the column elongating until a first failure of the radially extending bead 34 on the threaded rod 14, allowing the threaded rod 14 to extend fully from the bore 32 until restrained by the laterally-extending member 28. The first failure was followed by simultaneous flexure bending of the top plate 20 and the through-bolt at the bottom of the tubular member 12, resulting in an average of about 1 inch of elongation of the column 10 before total rupture of the bottom through-bolt.

The results of the testing of the prior art columns shows there is little resistance to uplift tension, although after failure of the radially extending bead 34 and extension of the threaded rod 14 until restrained by the laterally-extending member 28, the load can be resisted extensively to about 7478 lbs of force.

In the second sample it was observed that the radially extending bead 34 failed at about 77 psi (1515 lbs). Total rupture of the bottom through-bolt occurred at about 4014 lbs.

In the case of the six columns built according to an embodiment taught herein, an uplift-resisting apparatus 60 having an L-shaped housing 62, was connected to the top 18 of the tubular member 12 as described herein. The tubular member 12 was connected to the base plate 36 using one ½" Grade 8 bolt extending through the holes 48 in the tubular member 12 and the hole 52 in the upstanding member 44 welded to the base plate 36. The top plate 20 was connected to the testing machine using four ¼" Grade 8 bolts. The base plate 36 was connected to the testing machine using four ⅝" Grade 8 bolts.

In all cases, an increasing tension or uplift force was applied to each column 10 having the uplift-resisting assembly 60. Elongation continued in all cases until the top plate 20 began to bend as a result of the tension applied. The bottom bolt continued to bend without failure. Total rupture/break occurred when the 4, ½" bolts connecting the top plate to the testing apparatus failed in tension. Thus, it was observed that the connection of the column to the top connection, which in use would be the beam, failed before there was a failure of any of the components of the uplift-resisting assembly 60 or column 10. An average elongation of about 1.9% was observed in the column 10 and failure of the top connection occurred at an average force applied of about 11,076 lbs±422 lbs.

TABLE A

| Test Column | Head type Rod extension | Tolerance at head | Pre-test column length | Post-test column length | Pressure gauge at failure | Applied force at first points of failure* | Applied force at final failure** | Load resistance after failure |
|---|---|---|---|---|---|---|---|---|
| 1 | Conventional 4" extension | — | 50 9/16" | 52 11/16" | 380 psi | | 7478 lbs | |
| 2 | Conventional 4" extension | — | 50 9/16" | 52 11/16" | 204 psi | 1515 lbs | 4014 lbs | |
| 3 | Conventional 4" extension | — | 50 9/16" | 52 11/16" | 222 psi | | 4368 lbs | |
| Average | | | | | | 1500 lbs | 4000 lbs | 7478 lbs |
| 4 | L-shaped uplift-resistant 1½" extension | 1/16" | 51 15/16" | 52¾" | 555 psi | | 10,922 lbs | |
| 5 | L-shaped uplift-resistant 1 9/16" extension | 0" | 52" | 53" | 551 psi | | 10,843 lbs | |
| 6 | L-shaped uplift-resistant 2½" extension | 0" | 52 15/16" | 54" | 583 psi | | 11,473 lbs | |
| 7 | L-shaped uplift-resistant 3" extension | ⅛" | 52 15/16" | 54" | 596 psi | | 11,729 lbs | |
| 8 | L-shaped uplift-resistant 1⅝" extension | 0" | 52" | 53" | 542 psi | | 10,666 lbs | |
| 9 | L-shaped uplift-resistant 1¾" extension | 0" | 52⅛" | 53" | 550 psi | | 10,824 lbs | |
| Average | | | | | | | 11,076 lbs | |

The invention claimed is:

1. A structural column for supporting a structure thereabove and being resistant to compression and uplift loads, comprising:

an elongate, tubular member having a bore formed therethrough, an open bottom end and a closed top end, the closed top end having an opening therethrough;

a housing, having a top with an opening formed therein;

at least one side wall extending therefrom and secured to the tubular member at a top end thereof for spacing the top of the housing above the top end of the tubular member; and at least one open side;

a threaded rod, extending through the opening in the top of the housing and the opening in the closed top end of the tubular member and into the bore thereof and retained therein;

an adjustment nut threaded to the threaded rod and rotatably positioned between the top of the housing and the closed top end of the tubular member;

a top plate fixed to a top of the threaded rod, the plate being attachable to the structure thereabove for transferring load from the structure to the threaded rod; and a bottom plate secured to a lower end of the tubular member, the bottom plate being fastenable to a base structure, wherein the spacing between the top of the housing and the top end of the tubular member causes the adjustment nut to bear against the top of the housing in uplift loading and to bear against the closed top of the tubular member in compression loading, transferring the load to the tubular member.

2. The structural column of claim 1 wherein the base plate further comprises:

an upstanding member having a hole formed therethrough, wherein the lower end of the tubular member is positioned over the upstanding member and a fastener extends transversely through holes on opposing sides of the tubular member and the hole in the upstanding member for connection thereto.

3. The structural column of claim 1 further comprising:

a laterally-extending member, connected to a lower end of the threaded rod extending within the bore of the tubular member, to minimize lateral movement of the threaded rod therein.

4. The structural column of claim 1 further comprising:

a radially extending bead formed about the threaded rod to prevent the threaded rod from leaving the opening in the top end of the tubular member.

5. The structural column of claim 1 further comprising upper and lower washers located above and below the adjustment nut.

6. The structural column of claim 1 wherein the housing's at least one side wall comprises one side wall.

7. The structural column of claim 1 wherein the housing's at least one side wall comprises two side walls and wherein the two side walls are adjoining side walls.

8. The structural column of claim 1 wherein the housing's at least one side wall comprises two side walls and wherein the two side walls are opposing side walls.

9. The structural column of claim 1 wherein the top of the housing is contiguous with one of the at least one side walls.

10. The structural column of claim 1 wherein a lower end of each of the at least one side wall overlaps the tubular member for connection thereto.

11. The structural column of claim 10 wherein the lower end of the at least one side wall is welded to the tubular member.

12. The structural column of claim 1 wherein the spacing between the top of the tubular member and an underside of the top of the housing thereabove has a height tolerance, allowing rotational operation of the adjustment nut therein for adjusting an effective height of the structural column while minimizing uplift of the threaded rod.

13. The structural column of claim 12 wherein the adjustment nut is a ¾ inch hex nut and the height tolerance is about 1/16 inch.

14. The structural column of claim 12 wherein the adjustment nut is a ¾ inch hex nut and the height tolerance is from about 1/16 inch to about ⅛ inch.

* * * * *